US007963858B2

(12) United States Patent
Sanderson

(10) Patent No.: US 7,963,858 B2
(45) Date of Patent: Jun. 21, 2011

(54) GOLF PUTTER

(76) Inventor: Don Sanderson, Calgary (CA)

( * ) Notice: Subject to any disclaimer, the term of this patent is extended or adjusted under 35 U.S.C. 154(b) by 150 days.

(21) Appl. No.: 12/493,960

(22) Filed: Jun. 29, 2009

(65) Prior Publication Data

US 2010/0331099 A1 Dec. 30, 2010

(51) Int. Cl.
*A63B 53/02* (2006.01)
*A63B 53/04* (2006.01)

(52) U.S. Cl. ..... 473/314; 473/340

(58) Field of Classification Search ..... 473/340–341, 473/324, 328, 314, 251–255; D21/736–746
See application file for complete search history.

(56) References Cited

U.S. PATENT DOCUMENTS

| | | | | | |
|---|---|---|---|---|---|
| 1,531,821 | A | * | 3/1925 | Scott | 473/328 |
| 2,550,846 | A | * | 5/1951 | Milligan | 473/327 |
| D191,211 | S | | 8/1961 | Forest | |
| 3,068,011 | A | * | 12/1962 | Sano | 473/328 |
| 3,625,517 | A | * | 12/1971 | Durnack | 473/313 |
| 3,632,112 | A | | 1/1972 | Jacobs | |
| 3,881,733 | A | | 5/1975 | Csernits | |
| D246,541 | S | | 11/1977 | Meyers | |
| 5,340,106 | A | * | 8/1994 | Ravaris | 473/328 |
| 5,380,009 | A | * | 1/1995 | Henry et al. | 473/346 |
| 5,409,220 | A | | 4/1995 | Lombardo | |
| 5,423,544 | A | * | 6/1995 | Ichikawa | 473/340 |
| D361,357 | S | * | 8/1995 | Henry et al. | D21/752 |
| 5,456,464 | A | | 10/1995 | Davenport | |
| 5,456,469 | A | * | 10/1995 | MacDougall | 473/328 |
| 5,470,070 | A | | 11/1995 | Bendo | |
| 5,704,851 | A | * | 1/1998 | Lucetti | 473/328 |
| D398,354 | S | * | 9/1998 | Carter | D21/742 |
| D404,099 | S | * | 1/1999 | Mounfield, Jr. | D21/738 |
| 6,045,452 | A | | 4/2000 | Ahn | |
| D424,642 | S | * | 5/2000 | Reed et al. | D21/744 |
| 6,110,057 | A | | 8/2000 | McKinnon | |
| 6,183,379 | B1 | | 2/2001 | Kim | |
| 6,379,259 | B1 | * | 4/2002 | Opie | 473/251 |
| 6,464,599 | B1 | | 10/2002 | Wolf | |
| 6,547,672 | B1 | * | 4/2003 | Chough | 473/230 |
| 6,663,499 | B2 | | 12/2003 | Riseley | |
| 7,033,283 | B2 | | 4/2006 | Kang | |
| 7,232,379 | B2 | | 6/2007 | Riseley | |
| 7,244,190 | B2 | * | 7/2007 | McCracken | 473/313 |
| D552,698 | S | * | 10/2007 | Sizemore, Jr. | D21/736 |
| D565,681 | S | * | 4/2008 | Tanaka | D21/736 |
| 7,442,131 | B2 | | 10/2008 | Milana | |
| 7,462,112 | B1 | | 12/2008 | Sung | |
| 2002/0019264 | A1 | | 2/2002 | Buchanan | |
| 2002/0055395 | A1 | | 5/2002 | Douglas | |
| 2003/0045371 | A1 | * | 3/2003 | Wood et al. | 473/328 |
| 2005/0009623 | A1 | | 1/2005 | Dickinson | |
| 2005/0181889 | A1 | * | 8/2005 | Green | 473/340 |
| 2006/0142094 | A1 | * | 6/2006 | McCracken | 473/313 |
| 2007/0021229 | A1 | * | 1/2007 | Haack | 473/240 |

(Continued)

*Primary Examiner* — Stephen L. Blau
(74) *Attorney, Agent, or Firm* — Maxey Law Offices, PLLC; Stephen Lewellyn

(57) ABSTRACT

A golf putter having an improved club head construction comprising a tapered toe and heel, and cut-out portions to distribute weight towards the toe and heal of the club to preventing twisting and to prevent club head interaction with the ground during stroke. In an aspect, the club head further includes alignment indicator lines on an upward facing mounting surface and a alignment indicator line along a shaft connection portion that extends forwardly of the striking face of the club head.

10 Claims, 6 Drawing Sheets

U.S. PATENT DOCUMENTS

2007/0167253 A1* 7/2007 Sizemore, Jr. ..... 473/340
2008/0009362 A1 1/2008 Burns, Jr.
2008/0207350 A1 8/2008 Jung
2008/0300067 A1 12/2008 Hamlin

* cited by examiner

GOLF PUTTER

FILED OF THE INVENTION

The present invention relates generally to golf clubs, and more particularly, relating to an improved golf putter.

BACKGROUND OF THE INVENTION

Putting is an important part of golfing. Accurate putting requires attention to speed/distance and line. Speed/distance is controlled by the velocity and force applied to a ball, while line defines the direction of the moving ball. The line can only be made by the golfer, but the speed can be aided by a more consistent roll. A top spin roll is generally most desired because it is less likely to be affected by bumps on the green which might otherwise effect the line of the ball. Many golf putter designs have attempted to aid the golfer in producing a moving ball that has an appropriate top spin roll.

Another problem with accuracy in putting is caused by ground interaction. A golfer usually lines up the putter with the ball ("at address"), brings the club back ("takeaway"), and then hits the ball and follows through. The desired results are obtained when the putter is kept exactly as the golfer intended it. However, the putter is usually touching the ground at address. During takeaway, the putter may interact with the ground ("ground interaction"). The golfer aims to keep the putter slightly above the ground during the rest of the takeaway and follow through. However, sometimes the putter does touch the ground. Even the most carefully manicured course includes some irregularities in its greens. This can affect the aiming of the putter, and hence effect the line of the ball.

Another problem with accuracy in putting is caused by twisting of the putter during the stroke causing the striking face of the to strike the ball at an angle off of the line of ball resulting in an undesired ball trajectory.

Another problem with accuracy in putting is caused by an incorrect approach to the golf ball to be struck resulting in the ball being off center from the sweet spot or correct strike location on the striking surface.

SUMMARY OF THE INVENTION

The preferred embodiments of the present invention provide a golf putter of an improved construction which aids a golfer in striking a golf ball to induce a top spin.

The preferred embodiments of the present invention also provide a golf putter of an improved construction that minimizes surface contact area with the ground and thus preventing the club head from scuffing the ground during stroke.

The preferred embodiments of the present invention further provide a golf putter of an improved construction that minimizes twisting of the golf putter during stroke.

The preferred embodiments of the present invention further provide a golf putter of an improved construction that aids in proper golf ball addressing and follow through.

To achieve these and other advantages, in general, in one aspect, golf putter includes a shaft extending along an axis and a club head attached to the shaft. The club head has a vertical blade portion having a ball striking surface, opposed top and bottom edges, and opposed first and second side edges. The vertical blade portion tapers from wide to narrow in a direction from a vertical center line towards both the first and the second edges, and symmetrically about a longitudinal center line. The vertical blade portion has a first cut-out portion through the thickness of the vertical blade portion inwardly through the top edge, and symmetrically about the vertical center line. The vertical blade portion has a second cut-out portion through the thickness of the vertical blade portion inwardly through the bottom edge and symmetrically about the vertical center line. The first and the second cut-out portions are symmetrical about the longitudinal center line. A back portion extends rearwardly from the vertical blade portion between the first and the second side edges and along the longitudinal center line. The back portion has a thickness about equal to the width of the vertical blade portion as measured along the vertical center line between the first and the second cut-out portions. The back portion has an upwardly facing mounting surface and a rearward edge. The back portion has a third cut-out portion through the thickness of the back portion inwardly into the back portion from the rearward edge and symmetrical about a theta line that is perpendicular to both of the vertical center line and the longitudinal center line. The back portion tapers from wide to narrow along the longitudinal center line in a direction from the theta line towards both the first and the second edges. An arcuate neck portion has a lower end connected to the mounting surface and an upper end, wherein the arcuate neck portion extends upwardly and forwardly from the lower end to the upper end in a direction generally perpendicular to the ball striking surface. The upper end of the arcuate neck portion is located forward of the lower end. The arcuate neck portion is a single continuous curve extending from the lower end to the upper end and has an inward and downward facing surface and an opposed outward and upward facing surface. The lower end of the arcuate neck portion being connected to the mounting surface along the theta line. A shaft connecting portion has a lower end connected to the upper end of the arcuate neck portion and an upper end connected to the shaft, wherein the axis of the shaft extends at angle of between 0 degrees and 17 degrees from vertical and in a plane generally parallel to the ball striking surface when the putter is addressed with the bottom edge of the vertical blade portion disposed in a horizontal orientation.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
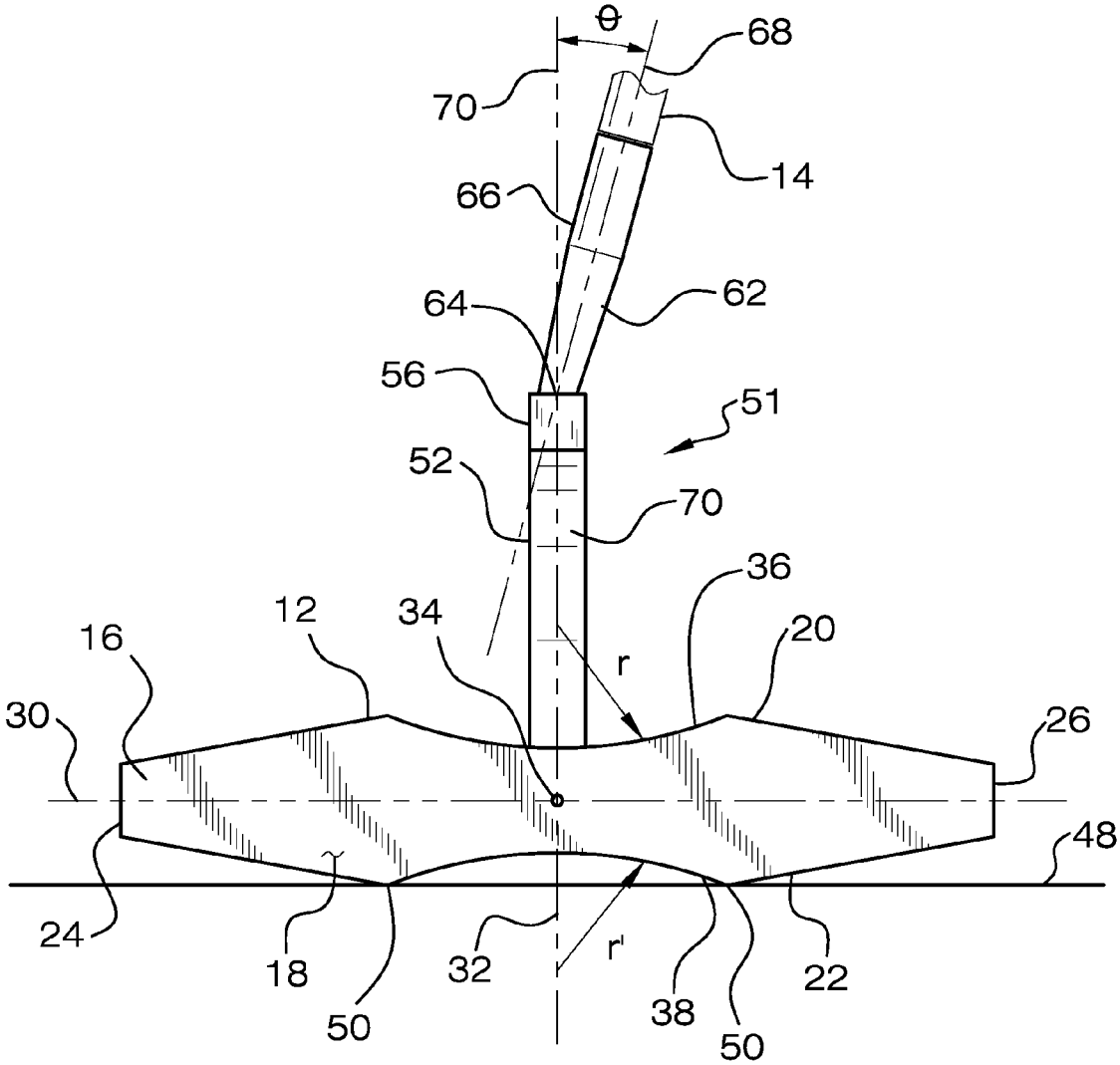
FIG. 1 is a front elevation view of a golf putter constructed in accordance with the principles of the present invention.

Reference will now be made in detail to the preferred embodiments of the present invention, examples of which are illustrated in the accompanying drawings. FIGS. 1-4, respectively, show front, top, side and back views of a first embodiment of a putter 10 according to the invention. The putter 10 includes a club head 12 and a shaft 14 which can include a handle or other elements allowing gripping of the putter. The head 12 includes a generally vertical blade portion 16 having a forward ball striking surface 18, a top edge 20, a bottom edge 22, and opposed side edges 24 and 26. Throughout discussion of the putter 10 the description and orientation of various elements of the putter will be made using reference to a longitudinal center line 30, a vertical center line 32, and a theta line 34 (extending into and out of the paper in FIG. 1).

The head 12 is symmetrical about the longitudinal center line 30 and the vertical center line 32 when viewed from the front, and is symmetrical about the theta line 34 when viewed from above. The vertical blade portion 16 tapers from wide to narrow along the longitudinal center line 30 in a direction from the vertical center line 32 towards side edges 24 and 26. A first cut-out portion 36 extends inwardly through the vertical blade portion 16 from the top edge 20. A second cut-out portion 38 extends inwardly through the vertical blade portion 16 from the bottom edge 22. Both the first and second cut-out portions 36 and 38 are symmetrical about the vertical center line 32. Both the first and second cut-out portions 36 and 38 are symmetrical to each other about the longitudinal center line 30. In one aspect, each cut-out portion 36 and 38 is semi-circular and can have a radius r' and r" of about 0.84 inches which is about equivalent to the radius of a typical golf ball. To this end, head 12 is faced balanced with the mass and thus weight of the vertical blade portion 16 is distributed towards side edges 24 and 26 to reduce twisting of the putter 10 during a putting stroke.

The head 12 includes a back portion 40 that extends rearwardly of vertical blade portion 16 between side edges 24 and 26 and along longitudinal center line 30. The back portion 40 has a thickness about equal to the width of the vertical blade portion 16 as measured along the vertical center line 32 between the cut-out portions 36 and 38. The back portion 40 further includes an upwardly facing mounting surface 42 and a rearward edge 44. The back portion 40 can taper from wide narrow in a direction from the theta line 34 towards side edges 24 and 26. A third cut-out portion 46 can extend inwardly into the back portion 40 through the rearward edge 44. Cut-out portion 46 is symmetrical about theta line 34. In one aspect, cut-out portion 46 can be semi-circular shaped and can have a radius r" of about 0.84 inches. To this end, the weight and thus mass of the back portion 40 is symmetrically balanced about theta line 34 to further reduce twisting of the putter 10 during a putting stroke.

As best seen in FIG. 1, the amount surface area of bottom edge 22 that is immediately adjacent to the ground surface 48 when the putter is addressed with the bottom edge of the vertical blade portion 16 disposed in a horizontal orientation is reduced to edges 50 defined by the intersection of the beginning and end of cut-out portion 38. To this end, scuffing of the head 12 along the ground surface during a stroke is reduced.

Figure 2:
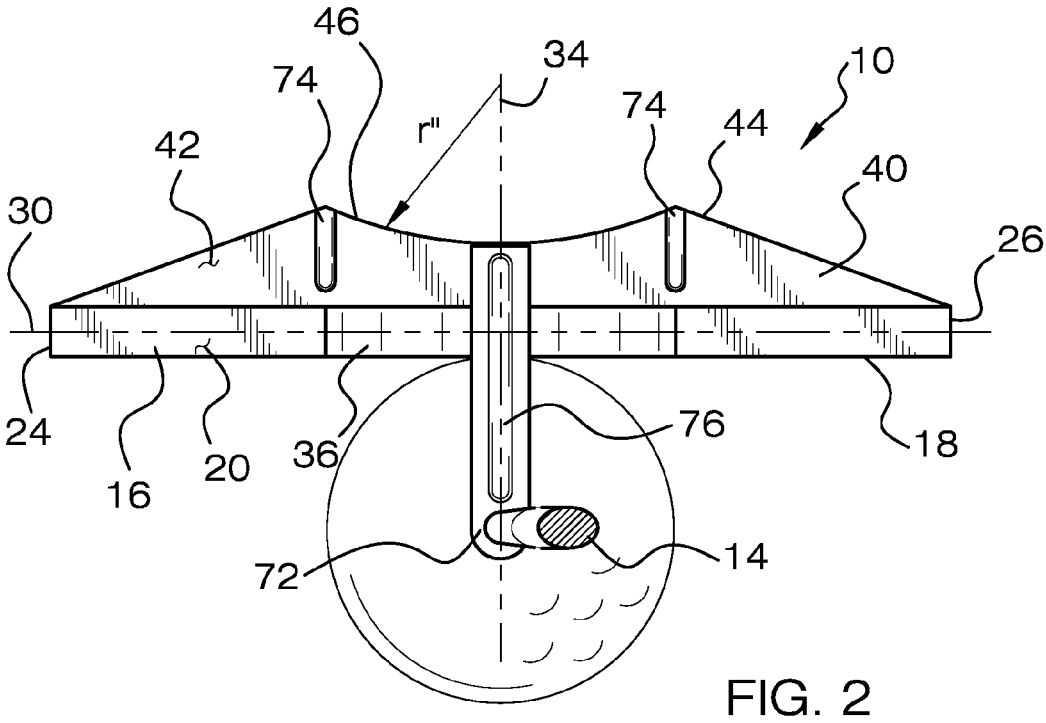
FIG. 2 is a top plan view of the golf club of FIG. 1.
Figure 3:
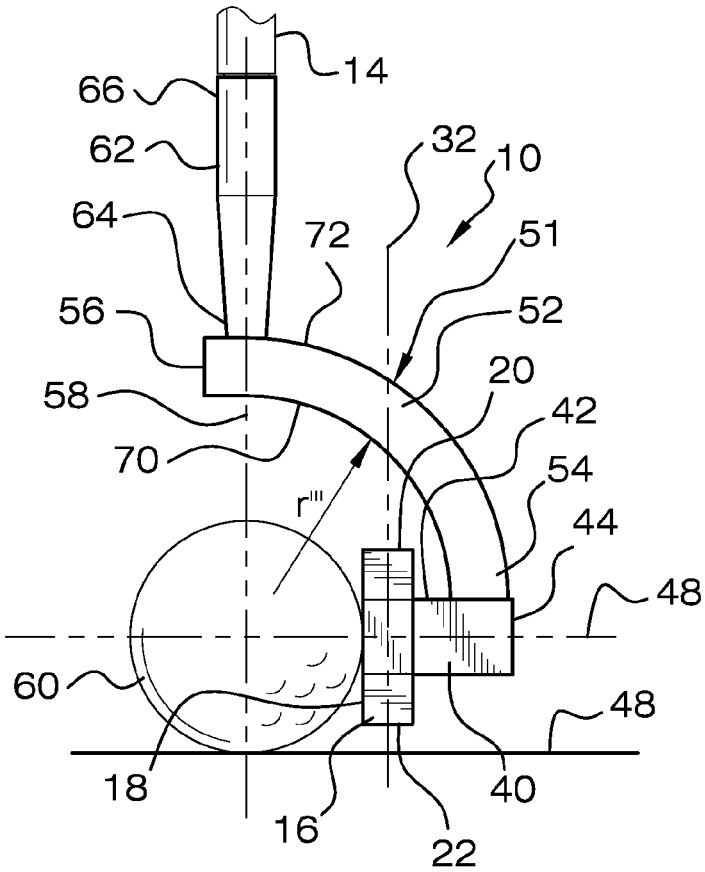
FIG. 3 is a side elevation view of the golf putter of FIG. 1.
Figure 4:
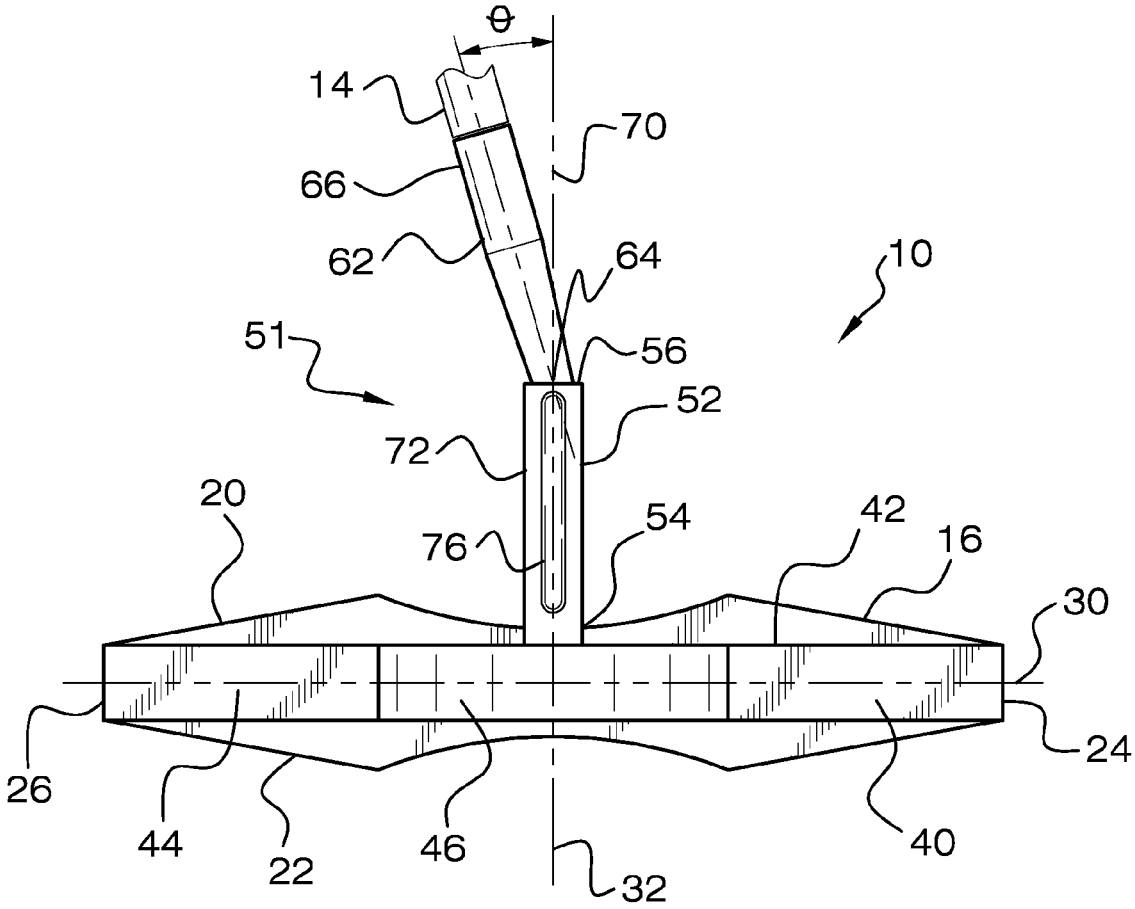
FIG. 4 is a back elevation view of the golf putter of FIG. 1.

A connecting portion 51 such as arcuate neck portion 52 is attached a at lower end 54 to the mounting surface 42 of the back portion 40 and extends upwardly and forwardly from the mounting surface to an upper end 56 in a direction generally perpendicular to the forward ball striking surface 18, as best seen in FIGS. 2 and 3. The upper end 56 of the neck portion 52 is located forward of the lower end 54 to be about a vertical axis 58 of ball 60 when the ball is address with the putter 1O. A shaft connecting portion 62 is connected at a lower end 64 to the upper end 56 of the neck portion 52 and at an upper end 66 to the shaft 14. The shaft connecting portion 62 extends from the neck portion 52 to position axis 68 of the shaft 14 at an angle Ø of between 0 degrees and 17 degrees from vertical 70 and in a plane generally parallel to the ball striking surface 18 when the putter 10 is address with the bottom edge 22 of the vertical blade portion 16 disposed in a horizontal orientation. As best seen in FIGS. 2 and 3, the shaft connecting portion 62, and thus the shaft 12 is positioned forward of the ball striking surface 18 and generally directly above the vertical axis 58 of the ball 60. To this end, a golfer is given an additional line of sight to the golf ball to aid in hitting the ball dead center. Additionally, during a stroke of the putter 10, the golfers hands are positioned forwardly of the striking facing 18 thereby causing an upward strike against the ball imparting a forward spin on the ball, and eliminating back spin on the ball.

The upper end 54 of the neck portion 52 is positioned approximately above the vertical axis 58 of ball 60 when the ball is address by the putter 10 with the bottom edge 22 of the vertical blade portion 16 disposed in a horizontal orientation and the with the ball striking surface 18 juxtaposed the ball. The neck portion 52 can be a single continuous curve extending from the lower end 54 to the upper end 56. The neck portion 52 has an inward and downward facing surface 70 and an opposed outward and upward facing surface 72. The lower end 54 of the neck portion is connected to the mounting surface 42 along the theta line 34 such that the putter 10 is a center shafted putter.

As best seen in FIG. 2, a first pair of spaced alignment lines 74 can be provided on the mounting surface 42 that are visible when the putter 10 is address by a golfer. The alignment lines 74 are spaced a distance approximately equal to golf ball 60, and are positioned to be symmetrical about theta line 34. Generally, alignment lines 74 indicate where the circumference of golf ball 60 should be positioned when addressed with putter 10, i.e. the golf ball 60 should be positioned between alignment lines 74 without any portion of the golf ball extending beyond any one alignment line 74. A third, center alignment line 76 can be provided along the length of surface 72 of neck portion 52 to further aid in centering the golf ball 60 between alignment lines 74. Alignment lines 74 can be colored a first color, while alignment line 76 can be colored a different color, i.e. alignment lines 74 could be colored red, and alignment line 76 could be colored blue to further aid in visual acuity in addressing a golf ball with putter 10.

Figure 5:
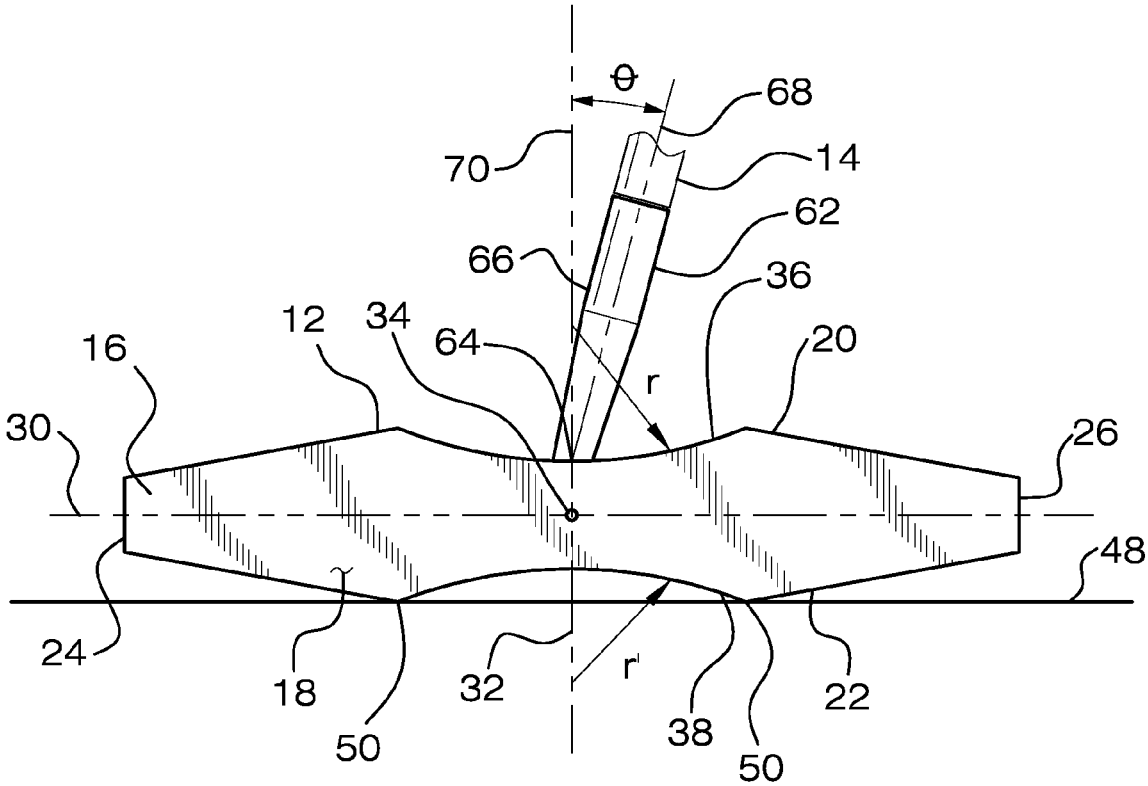
FIG. 5 is a front elevation view another embodiment of a golf putter constructed in accordance with the principles of the present invention.
Figure 6:
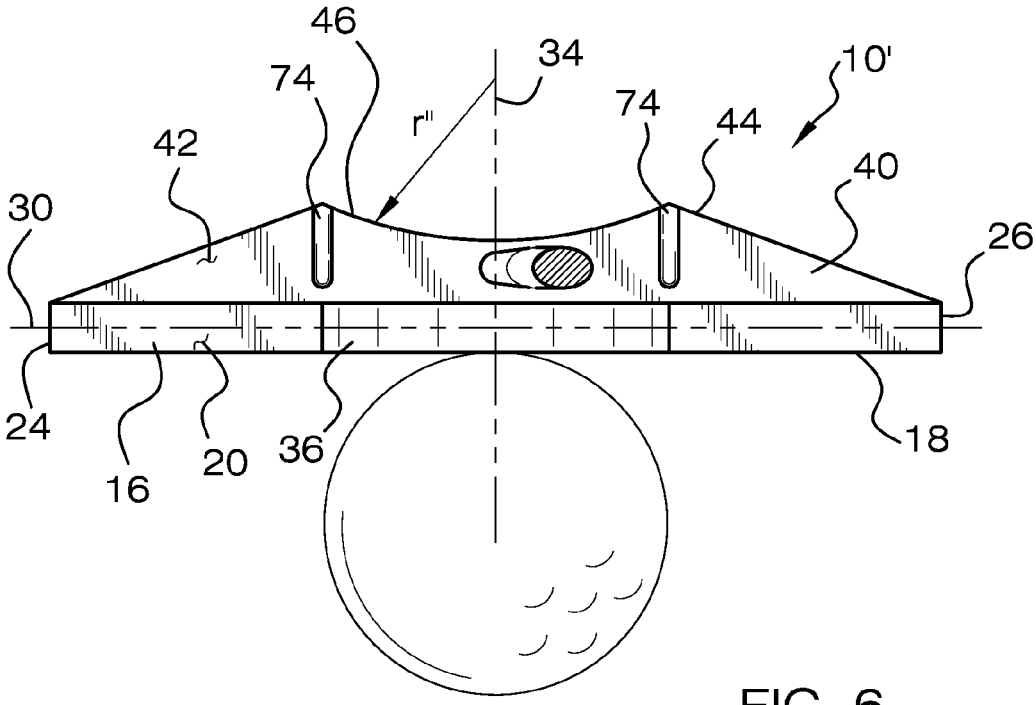
FIG. 6 is a top plan view of the golf club of FIG. 5.
Figure 7:
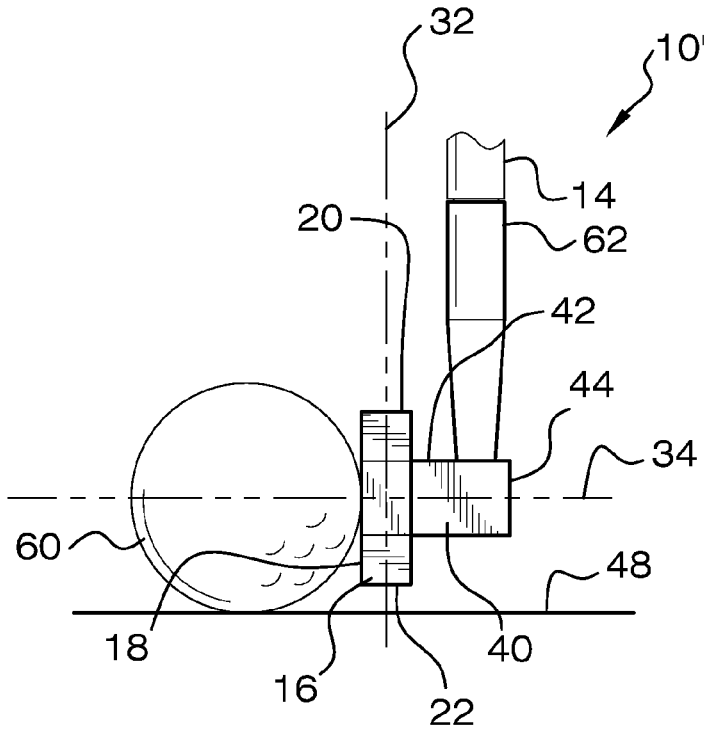
FIG. 7 is a side elevation view of the golf putter of FIG. 5.
Figure 8:
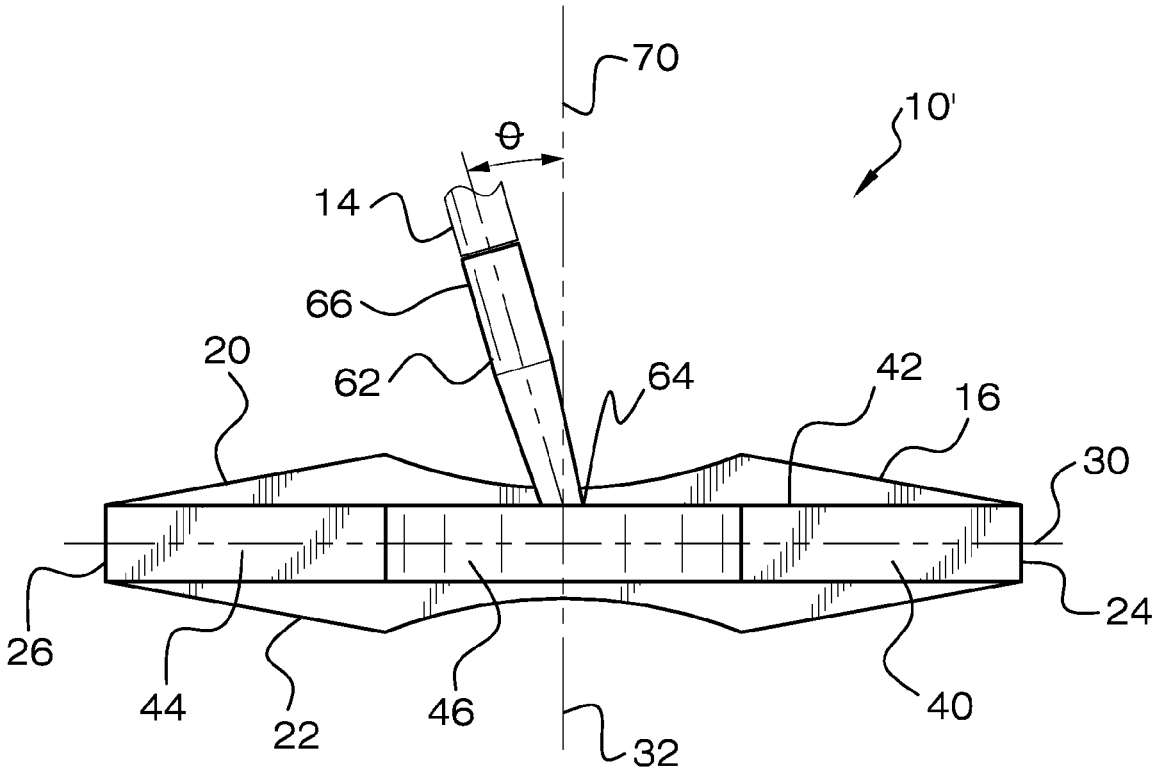
FIG. 8 is a back elevation view of the golf putter of FIG. 5.

FIGS. 5-7, respectively, show front, top, side and back views of another illustrative embodiment of the invention in the form of a putter 10'. In these figures, reference numerals with prime marks (') refer to structure which is somewhat altered from the corresponding structure denoted with the same numerals and discussed in FIGS. 1-4. Putter 10' is another faced balanced center shafted blade style putter constructed in accordance with the invention. Connecting portion 51' comprises shaft connecting portion 62 connected at a lower end 64 to mounting surface 42 and at an upper end 66 to the shaft 14. Shaft connecting portion 62 extends from the mounting surface 42 to position axis 68 of the shaft 14 at an angle Ø of between 0 degrees and 17 degrees from vertical 70 and in a plane generally parallel to the ball striking surface 18 when the putter 10' is address with the bottom edge 22 of the vertical blade portion 16 disposed in a horizontal orientation.

A number of embodiments of the present invention have been described. Nevertheless, it will be understood that various modifications may be made without departing from the spirit and scope of the invention. Accordingly, other embodiments are within the scope of the following claims.

What is claimed is:

1. A golf putter comprising:

a shaft extending along an axis;

a club head including:

a vertical blade portion having a ball striking surface, opposed top and bottom edges, and opposed first and second side edges, said vertical blade portion tapering from wide to narrow in a direction from a vertical center line towards both said first and said second edges, and symmetrically about a longitudinal center line, said vertical blade portion defining a first cut-out portion through the thickness of said vertical blade portion inwardly through said top edge, and symmetrically about said vertical center line, said vertical blade portion defining a second cut-out portion through the thickness of said vertical blade portion inwardly through said bottom edge and symmetrically about said vertical center line, said first and said second cut-out portions being symmetrical about said longitudinal center line;

a back portion extending rearwardly from said vertical blade portion between said first and said second side edges and along said longitudinal center line, said back portion having a thickness about equal to the width of said vertical blade portion as measured along said vertical center line between said first and said second cut-out portions, said back portion having an upwardly facing mounting surface and a rearward edge, said back portion defining a third cut-out portion through the thickness of said back portion inwardly into said back portion from said rearward edge and symmetrical about a theta line that is perpendicular to both of said vertical center line and said longitudinal center line, said back portion tapering from wide to narrow along said longitudinal center line in a direction from said theta line towards both said first and said second edges;

an arcuate neck portion having a lower end connected to said mounting surface and an upper end, wherein said arcuate neck portion extends upwardly and forwardly from said lower end to said upper end in a direction generally perpendicular to said ball striking surface, and said upper end of said arcuate neck portion is located forward of said lower end, wherein said arcuate neck portion is a single continuous curve extending from said lower end to said upper end, said arcuate neck portion having an inward and downward facing surface and an opposed outward and upward facing surface, said lower end of said arcuate neck portion being connected to said mounting surface along said theta line; and a shaft connecting portion having a lower end connected to said upper end of said arcuate neck portion and an upper end connected to said shaft, wherein said axis of said shaft extends at angle of between 0 degrees and 17 degrees from vertical and in a plane generally parallel to said ball striking surface when the putter is addressed with said bottom edge of said vertical blade portion disposed in a horizontal orientation.

2. The golf putter of claim 1, wherein said arcuate neck portion has a radius of about 1.75 inches.

3. The golf putter of claim 1, wherein said first and said second cut-out portions are semi-circular shaped and have a radius of about 0.84 inches.

4. The golf putter of claim 3, where said third cut-out portion is semi-circular shaped and has a radius of about 0.84 inches.

5. The golf putter of claim 1, further comprising:

spaced edge alignment lines on said mounting surface spaced a distance of about 1.68 inches symmetrical about said theta line.

6. The golf putter of claim 5, further comprising center alignment line on said outward and upward facing surface of said arcuate neck portion.

7. A golf putter comprising:

a shaft extending along an axis;

a vertical blade portion having a ball striking surface, opposed top and bottom edges, and opposed first and second side edges, said vertical blade portion tapering from wide to narrow in a direction from a vertical center line towards both said first and said second edges, and symmetrically about a longitudinal center line, said vertical blade portion defining a first cut-out portion through the thickness of said vertical blade portion inwardly through said top edge, and symmetrically about said vertical center line, said vertical blade portion defining a second cut-out portion through the thickness of said vertical blade portion inwardly through said bottom edge and symmetrically about said vertical center line, said first and said second cut-out portions being symmetrical about said longitudinal center line;

a back portion extending rearwardly from said vertical blade portion between said first and said second side edges and along said longitudinal center line, said back portion having a thickness about equal to the width of said vertical blade portion as measured along said vertical center line between said first and said second cut-out portions, said back portion having an upwardly facing mounting surface and a rearward edge, said back portion defining a third cut-out portion through the thickness of said back portion inwardly into said back portion from said rearward edge and symmetrical about a theta line that is perpendicular to both of said vertical center line and said longitudinal center line, said back portion tapering from wide to narrow along said longitudinal center line in a direction from said theta line towards both said first and said second edges; and a shaft connecting portion having a lower end connected to said mounting surface of said back portion and an upper end connected to said shaft, wherein said axis of said shaft extends at angle of between 0 degrees and 17 degrees from vertical and in a plane generally parallel to said ball striking surface when the putter is addressed with said bottom edge of said vertical blade portion disposed in a horizontal orientation.

8. The golf putter of claim 7, wherein said first and said second cut-out portions are semi-circular shaped and have a radius of about 0.84 inches.

9. The golf putter of claim 8, where said third cut-out portion is semi-circular shaped and has a radius of about 0.84 inches.

10. The golf putter of claim 7, further comprising:

spaced edge alignment lines on said mounting surface spaced a distance of about 1.68 inches symmetrical about said theta line.

* * * * *